US006717084B1

(12) United States Patent
Lu

(10) Patent No.: US 6,717,084 B1
(45) Date of Patent: Apr. 6, 2004

(54) CONTACT SWITCH

(75) Inventor: Wen-Hsiang Lu, Hsin-Tien (TW)

(73) Assignee: Zippy Technology Corp., Taipei Hsien (TW)

( * ) Notice: Subject to any disclaimer, the term of this patent is extended or adjusted under 35 U.S.C. 154(b) by 0 days.

(21) Appl. No.: 10/424,124

(22) Filed: Apr. 28, 2003

(51) Int. Cl.[7] ..... H01H 13/28
(52) U.S. Cl. ..... 200/462; 200/467
(58) Field of Search ..... 200/402, 405, 200/445, 453, 454, 456, 457, 459, 461–464, 467

(56) References Cited

U.S. PATENT DOCUMENTS 3,337,702 A * 8/1967 Brevick et al. ..... 200/467
3,382,332 A * 5/1968 Cherry et al. ..... 200/467
4,877,930 A * 10/1989 Fukuma ..... 200/302.2
4,929,808 A * 5/1990 Roeser et al. ..... 200/467
5,171,945 A 12/1992 Su ..... 200/6 R
5,432,311 A 7/1995 Lin ..... 200/467
5,717,177 A 2/1998 Tsai et al. ..... 200/16 R
5,871,087 A 2/1999 Su ..... 200/462

* cited by examiner

*Primary Examiner*—Michael A. Friedhofer
(74) *Attorney, Agent, or Firm*—Birch, Stewart, Kolasch & Birch, LLP

(57) ABSTRACT

A contact switch aims to reduce damages caused by electro-static discharge and facilitate depressing operation. It includes a casing which has a housing compartment for holding a first contact leg. The first contact leg has a first anchor flange and a second anchor flange projecting in the direction of a depressing opening. A micro mechanism is located at a lower position to increase the electro-static discharge. Due to the lower position of the micro mechanism, a retaining section may be formed by extension to space from the first anchor flange to form a depressing space so that a pushbutton may be moved therein without skewing to establish secured electric connection of the contact switch.

4 Claims, 5 Drawing Sheets

CONTACT SWITCH

FIELD OF THE INVENTION

The present invention relates to a contact switch and particularly to a contact switch adopted for use in electronic products such as mouse to form electric connection by depressing a pushbutton.

BACKGROUND OF THE INVENTION

Contact switches or microswitches have been widely used in electronic products. In order to confine Electro-Static Discharge (ESD) and avoid electrical failure, to lower the conductive position of metal contact legs to prevent instantaneous high voltage discharge from occurring and affecting the inner circuits has become one of the key focuses of research and development efforts in the switch industry.

Refer to FIGS. 1A and 1B for U.S. Pat. No. 5,432,311, entitled: "Common conducting unit for a contact switch" granted to Applicant. For the contact switch adopted for two staged electronic products, it has a smaller total size when coupled with the mating device. Thus it is desirable for small size products such as mouse. However, as ESD test standards have become increasingly strict, industry requirement of the test standard for non-contact electronic products is +/−16 KV. It is twice the normal test standard. Hence industry requirements for ESD test also are higher. The prior art has a common leg formed in U-shape. Installation point of the micro mechanism is located on a upper portion closed to the depressing opening. It cannot meet the stricter test requirements. Hence to lower installation for the micro mechanism is a big issue to be overcome.

U.S. Pat. No. 5,171,945, entitled: "Contact switch" which also was granted to the Applicant, discloses a contact switch which has a mounting plate member that enables a micro mechanism to be installed on a common leg spacing from a depressing opening at a greater interval. But it is mainly adopted on electronic switches of three conductors. The design has to couple with other connection legs and casing. If the structure of the common leg can be adapted on existing switches, it would be a great breakthrough.

Moreover, the pushbutton employed in the foregoing switches has a drawback. When the pushbutton is depressed into the casing to push the spring, it is supported only by the spring. A skew is prone to take place and results in a non-vertical downward pressure. The spring tends to receive a uneven or inadequate force and result in electric connection failure. The skewed downward pressure could even cause deformation and damage of the spring. This is another issue to be resolved.

SUMMARY OF THE INVENTION

The primary object of the invention is to resolve the aforesaid disadvantages. The inventions provides an improved contact switch structure that combines the advantages of the two patents mentioned above and couples with matching casing, lid and legs. The casing has a housing compartment which has a first and a second anchor ledges projecting in the same direction of the depressing opening of a first contact leg. The micros mechanism installation location is lowered to achieve a higher ESD. In addition, the depressing opening of the casing is extended to form a retaining section which forms a depressing space with a first anchor flange resulting from the micro mechanism being located at a lower position, the pushbutton may be moved in the depressing space without skewing. Thus the contact switch can establish desired electric connection when depressed.

DETAILED DESCRIPTION OF THE PREFERRED EMBODIMENT

Figure 1A:
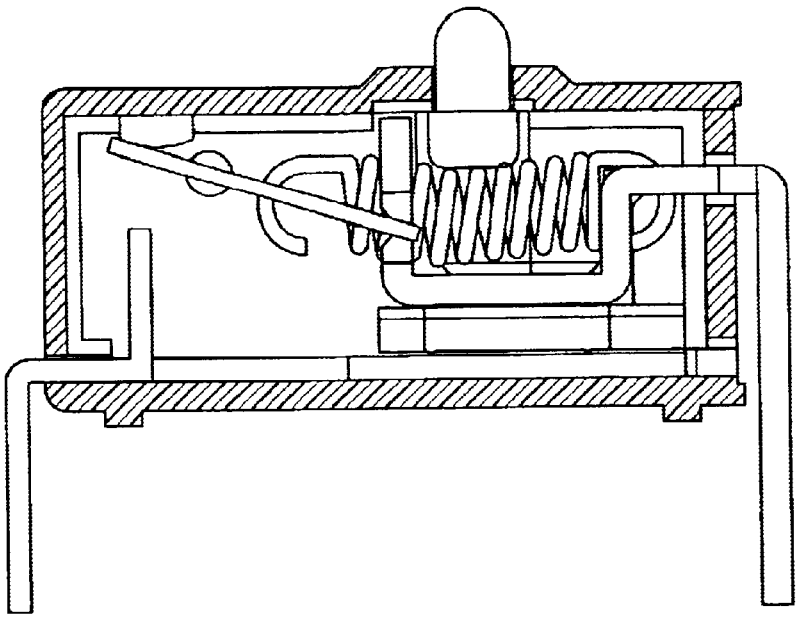
Fig. 1A PRIOR ART
FIGS. 1A and 1B are schematic views of a conventional contact switch.
Figure 1B:
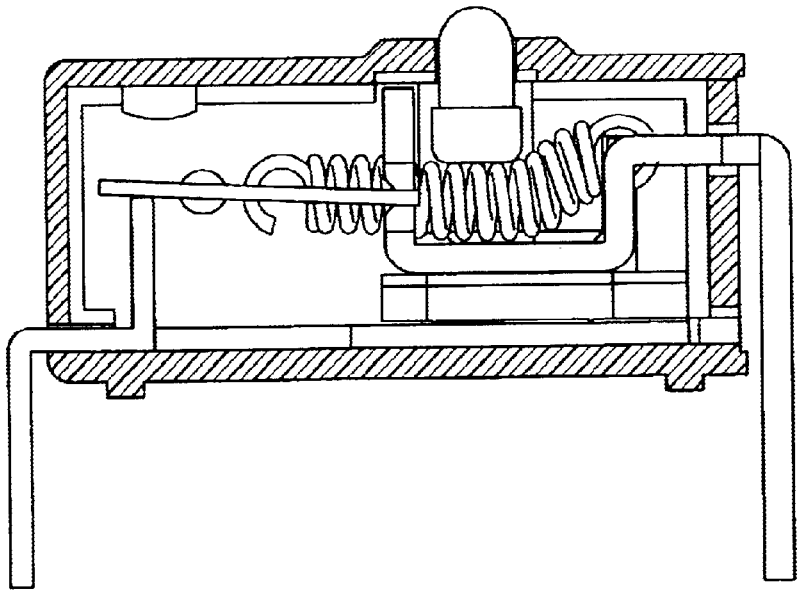
Fig. 1B PRIOR ART
Figure 2:
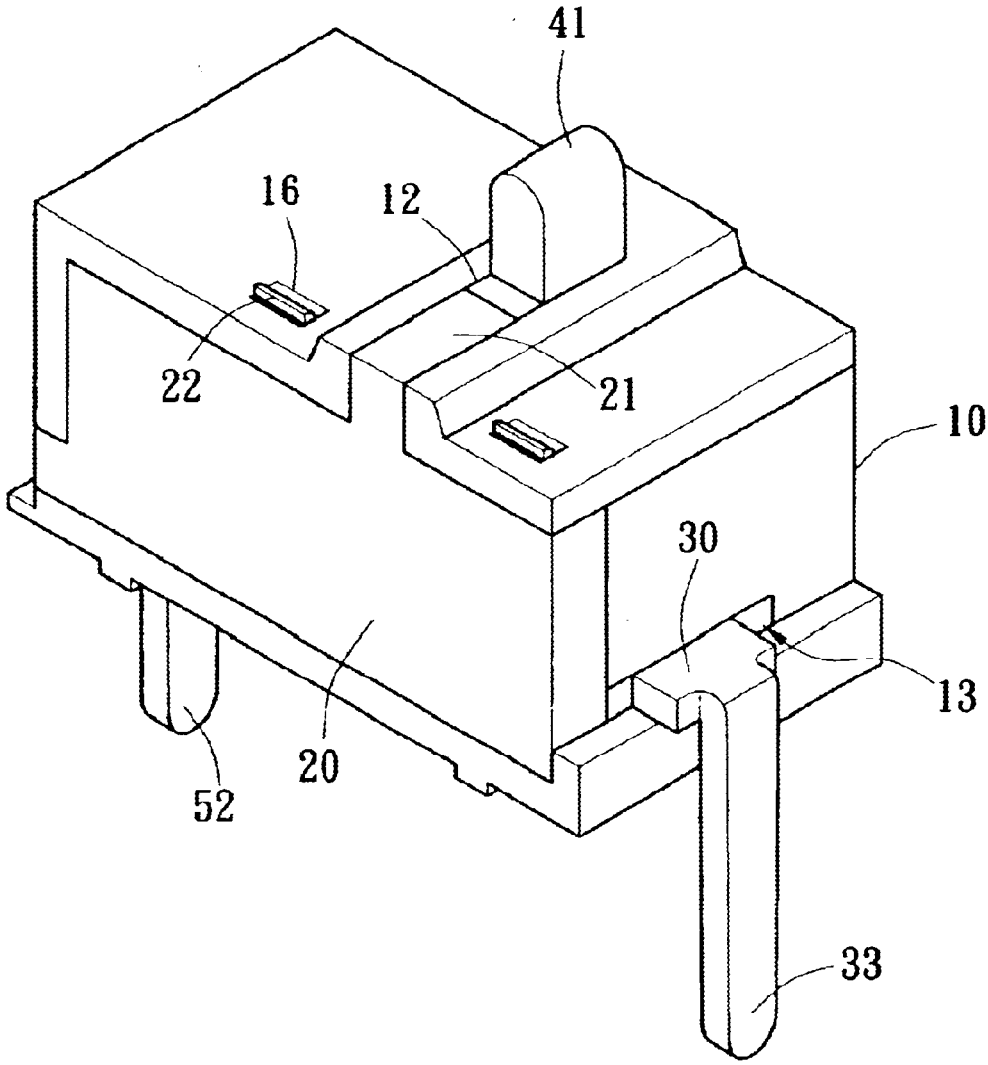
FIG. 2 is a perspective view of the present invention.
Figure 3:
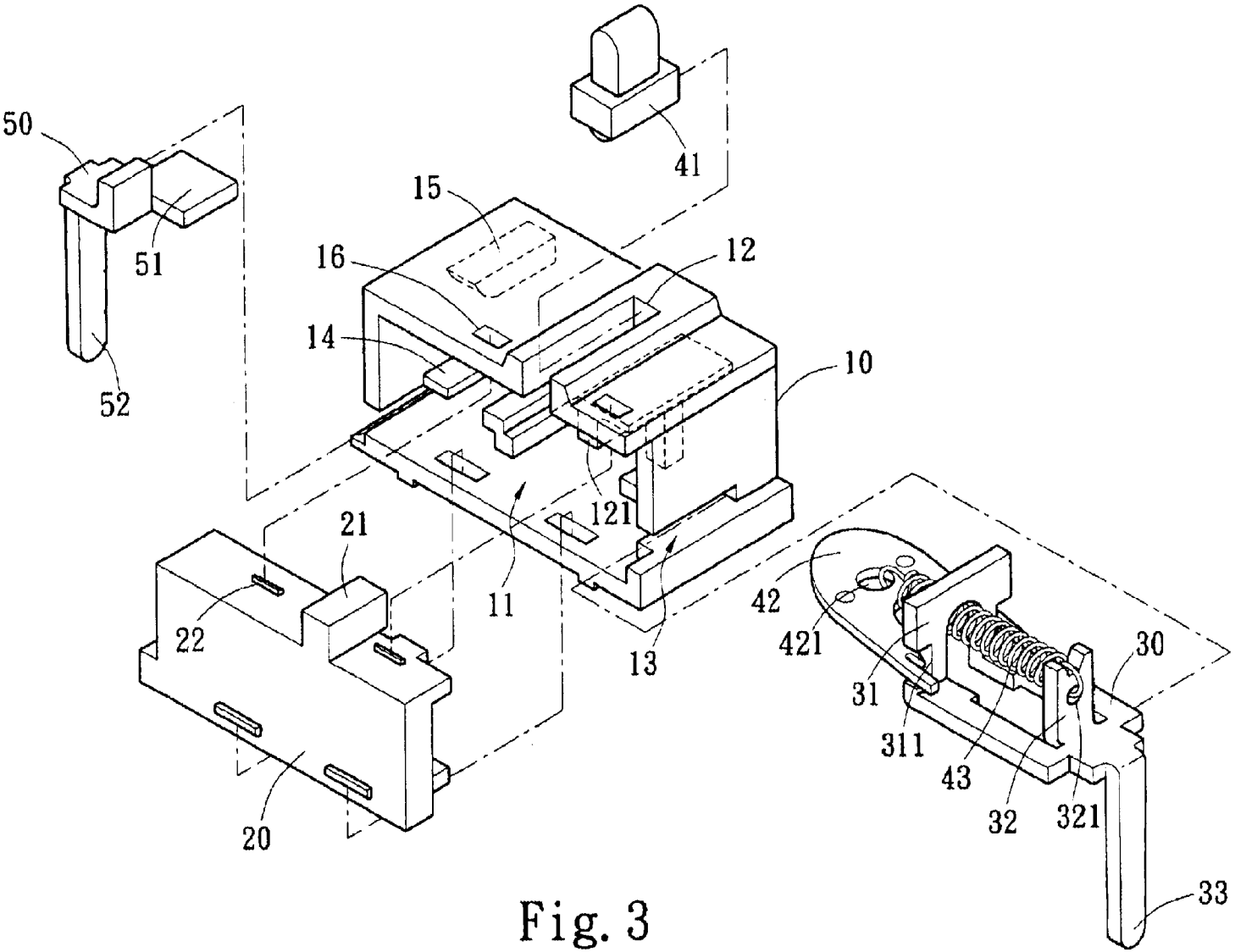
FIG. 3 is an exploded view of the present invention.
Figure 4:
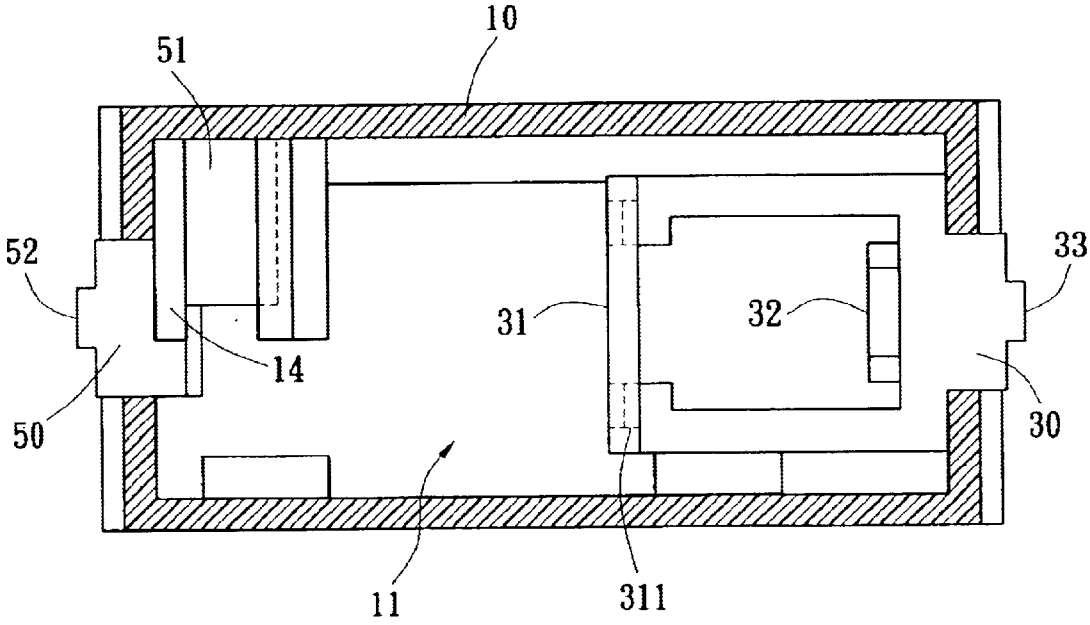
FIG. 4 is a schematic view of the configuration of the first and the second contact legs of the present invention.

Please refer to FIGS. 2, 3 and 4 for the perspective view and the exploded view and the configuration of a first contact leg 30 and a second contact leg 50 of the present invention. As shown in the drawings, the invention mainly includes a casing 10 which has a housing compartment 11. The housing compartment 11 has an opening covered by a lid 20 and two slots 13. The casing 10 and the lid 20 have respectively an anchor hole 16 and an anchor stub 22 corresponding to and engageable with each other. The lid 20 further has a ridge 21 to seal a depressing opening 12 formed on the casing 10. The casing 10 further has a retaining section 121 extending downwards from the depressing opening 12 into the housing compartment 11. The housing compartment 11 houses a first contact leg 30 and a second contact leg 50 that extend through the slots 13 to form respectively a first fastening ledge 33 and a second fastening ledge 52. The first contact leg 30 has a first anchor flange 31 and a second anchor flange 32 projecting in the direction of the depressing opening 12. The first anchor flange 31 has a support strut 311 spaced from the retaining section 121 to form a depressing space. The second anchor flange 32 has an anchor portion 321. The second contact leg 50 has an anchor section 51. In the housing compartment 11, there is an anchor plate 14 to hold the anchor section 51. Inside the casing 10, there is a micro mechanism which includes a pushbutton 41 movable in the depressing space through the depressing opening 12, a contact plate 42 which has one end pressing the support strut 311 and another end forming an anchor member 421, and an elastic element 43 which has two ends engaging respectively with the anchor portion 321 of the second anchor flange 32 and the anchor member 421 of the contact plate 42, and is depressible downward by the pushbutton 41 to drive the contact plate 42 to move about the support strut 311 to connect the second contact leg 50 to establish electric connection.

Figure 5A:
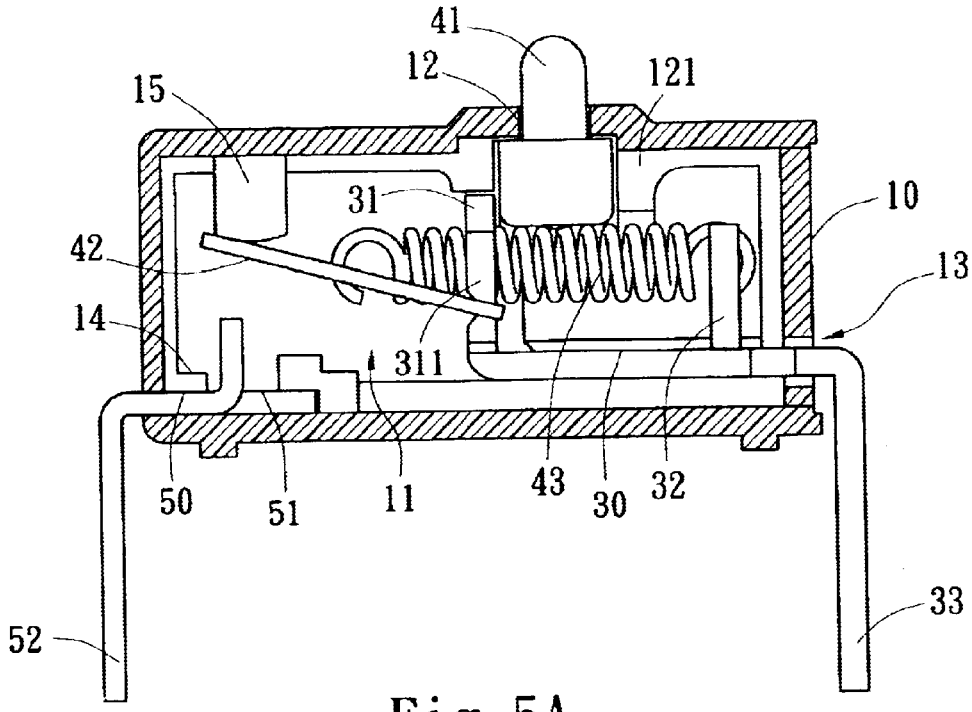
FIGS. 5A and 5B are schematic views of the contact switch of the present invention in operating conditions.
Figure 5B:
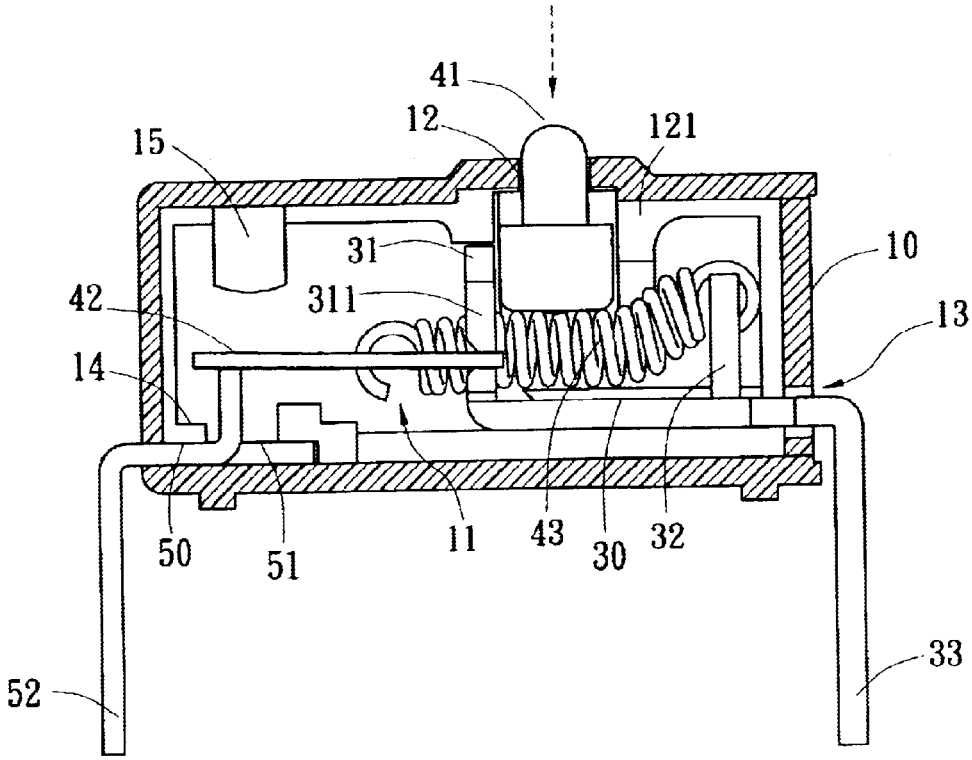

Refer to FIGS. 5A and 5B for the invention in operating conditions. As shown in the drawings, as the installation positions of the metallic first and second contact legs 30 and 50 and the micro mechanism have been moved lower, the interval of the electric connection and the depressing opening 12 increases, thus it can better meet ESD test requirements. Moreover, the retaining section 121 and the first anchor flange 31 form a depressing space due to the micro mechanism being located lower, the pushbutton 41 may be depressed steadily in the depressing space to move the elastic element 43 without skewing. Hence the elastic element 43 can receive a balanced force to drive the contact plate 42 downward to connect the second contact leg 50 to establish electric connection (as shown in FIG. 5B). In addition, the casing 10 also has a bucking section 15 corresponding to the contact plate 42 in the free condition to limit the travelling displacement of the contact plate 42 so that the elastic force applying on the pushbutton 41 is not excessively strong to facilitate user depressing operation. Operation of the micro mechanism is known in the art, thus details are omitted.

What is claimed is:

1. A contact switch, comprising:

a casing having a housing compartment and a depressing opening, the housing compartment having an opening covered by a lid, two slots and a retaining section extending from the depressing opening;

a first contact leg and a second contact leg located in the housing compartment that extend through the slots to form respectively a first fastening ledge and a second fastening ledge, the first contact leg having a first anchor flange and a second anchor flange projecting in the direction of the depressing opening, the first anchor flange having a support strut spaced from the retaining section to form a depressing space, the second anchor flange having an anchor portion; and a micro mechanism including a pushbutton movable in the depressing space through the depressing opening, a contact plate which has one end pressing the support strut and another end forming an anchor member, and an elastic element which has two ends engaging respectively with the anchor portion of the second anchor flange and the anchor member of the contact plate and is depressible downward by the pushbutton to drive the contact plate to move about the support strut to connect the second contact leg to establish electric connection.

2. The contact switch of claim 1, wherein the casing and the lid have respectively an anchor hole and an anchor stub corresponding to and engageable with each other, and the lid further has a ridge to seal the depressing opening.

3. The contact switch of claim 1, wherein the second contact leg has an anchor section and the housing compartment has an anchor plate for holding the anchor section.

4. The contact switch of claim 1, wherein the casing has a bucking section corresponding to the contact plate in a free condition.

* * * * *